United States Patent [19]

Santorineos et al.

[11] Patent Number: 4,848,194

[45] Date of Patent: Jul. 18, 1989

[54] VALVE WRENCH

[76] Inventors: Peter J. Santorineos, 400 Cedar La., Shorewood, Ill. 60435; Steve Lawson, 358 Orchard La., Braidwood, Ill. 60408

[21] Appl. No.: 242,652

[22] Filed: Sep. 12, 1988

[51] Int. Cl.[4] ..... B25B 13/48

[52] U.S. Cl. ..... 81/176.1; 81/176.2; 81/177.2

[58] Field of Search ..... 81/119, 176.1, 176.2, 81/177.2, 177.85

[56] References Cited

U.S. PATENT DOCUMENTS

| | | | |
|---|---|---|---|
| 1,429,639 | 9/1922 | Saloun | 81/177.85 X |
| 1,511,395 | 10/1924 | Canan | 81/119 U X |
| 1,535,281 | 4/1925 | Zilliox | 81/119 |
| 2,086,722 | 7/1937 | Matuella | 81/176.2 X |
| 2,682,189 | 6/1954 | Bergman | 81/119 |
| 4,715,252 | 12/1987 | Pella | 81/176.1 |
| 4,751,840 | 6/1988 | Windsor | 81/176.1 X |

*Primary Examiner*—James G. Smith

*Attorney, Agent, or Firm*—Ernest Kettelson

[57] ABSTRACT

A valve wrench comprising a wrench for valves having a hand wheel operator, combined with the elongated handle of an adjustable wrench to supply the leverage required. The valve wrench has an elongated body having an elongated, slightly tapered seat portion corresponding to the slightly tapered end portion of the handle of an ordinary adjustable wrench to receive such end portion of the handle therein. The corresponding tapered configuration keeps the valve wrench from slipping off the end of the adjustable wrench. A screw and washer extend through an aperture in the end of the adjustable wrench handle to clamp the bottom wall of the valve wrench securely against the facing wall of the adjustable wrench handle. The screw and washer may be replaced by a valve wrench that is integrally formed with an adjustable wrench. The working end of the valve wrench has speced apart inner and outer jaw members which define a jaw recess to snugly receive the rim of the hand operator of the valve. The inner and outer jaw members have fixed-positions, spaced apart a distance corresponding to the cross-sectioned thickness of the rim of the hand wheel. The jaw members may be adjustable.

11 Claims, 3 Drawing Sheets

VALVE WRENCH

BACKGROUND OF THE INVENTION

This invention relates to the field of combination wrenches, and in particular to valve wrenches which fit on the hand wheel of a valve thereby increasing leverage and the mechanical advantage for an individual when opening and closing a valve.

Prior art combination wrench designs have been aimed at increasing the leverage and mechanical advantage in tightening or loosening nuts, bolts, or pipes. No combination wrench design has addressed the problem of rotating hand wheel operators to open and close valves.

The problem with prior art combination wrenches is that they cannot grasp the circular shaped hand wheel operator without having considerable looseness of the hand wheel rim relative to the wrench. It is common for valves to be difficult to open and close due to nonuse or poor accessibility. When these problems occur, a valve wrench must be used.

Examples of prior art devices include those disclosed in the following United States Patents:

U.S. Pat. No. 4,738,167 discloses an extending device for tools having a circular shape with the top covered with a small square configured central opening. The bottom of the cylindrical configuration has a cut out oval shaped channel running diametrically through the cylinder. The cylinder is placed upon the handle of a tool so that the channel contains the hand portion of the tool. A ratchet or other driver means is placed in the square shaped opening on the top of the cylinder. This arrangement then increases the leverage and mechanical advantage for an individual when trying to loosen or tighten nuts, bolts, or pipe. One problem with this device is that it cannot accept circular shaped objects due to the channels longitudinal design. Another problem with this device is that it requires other tools to function. Unlike a combination wrench of solid design, this device works in combination with other tools which creates an unstable arrangement when trying to increase leverage.

U.S. Pat. No 4,729,281 discloses a conventional wrench with an extension handle apparatus. The extension handle has a plurality of openings that align with an opening in the conventional wrench. A bolt is then inserted through both openings and secured so that the extension handle is locked in place. The leverage of the conventional wrench is then increased an amount proportional to the extension handle setting.

U.S. Pat. No. 4,596,167 discloses a wrench set having individual wrenches comprising a straight shank with one end a stud socket and the other a stud drive. Individual wrenches can be combined in a straight line to multiply leverage when tightening or loosening nuts and bolts.

U.S. Pat. No. 1,371,533 discloses a wrench extension handle. A conventional double-end fixed jaw wrench is used in combination with an extension handle to increase leverage when tightening or loosening nuts and bolts. The extension handle design is such that one end interlocks with either end of the double-ended fixed jaw wrench thereby eliminating the need for clamping devices to join the two together.

U.S. Pat. No. 960,691 discloses a pipe wrench that has been modified so that the handle end features a hammer, wire cutter and pincers U.S. Pat. No. 383,049 discloses a pipe wrench that has been modified so that the handle end features a ratchet device to tighten or loosen nuts and bolts of varying sizes.

SUMMARY OF THE INVENTION

It is an object of this invention to provide a valve wrench and adjustable wrench combination which snugly receives the rim of a hand wheel operator of a valve.

It is an object of this invention to provide a valve wrench and adjustable wrench combination with a valve wrench having a slightly tapered seat portion corresponding to the slightly tapered end portion of the handle of an ordinary adjustable wrench to receive such end portion of the handle therein.

It is an object of this invention to provide a valve wrench and adjustable wrench combination with securing means to clamp the bottom wall of the valve wrench securely against the facing wall of the adjustable wrench handle.

It is an object of this invention to provide a valve wrench and adjustable wrench combination with the valve wrench comprising spaced apart inner and outer jaw members which define a jaw recess corresponding to the cross-sectional thickness of the rim of a hand wheel.

It is an object of this invention to provide a valve wrench and adjustable wrench combination comprising a valve wrench with an elongated body having an elongated slightly tapered seat portion corresponding to the slightly tapered end portion of the handle of an ordinary adjustable wrench to receive such end portion of the handle therein, fastening means to secure the bottom wall of the valve wrench securely against the facing wall of the adjustable wrench handle, inner and outer jaw members on the working end of the valve wrench, with the members spaced apart a distance corresponding to the cross-sectional thickness of the rim of the hand wheel, a jaw recess defined by the jaw members to snugly receive the rim of the hand wheel operator of the valve.

DESCRIPTION OF THE PREFERRED EMBODIMENT

Figure 1:
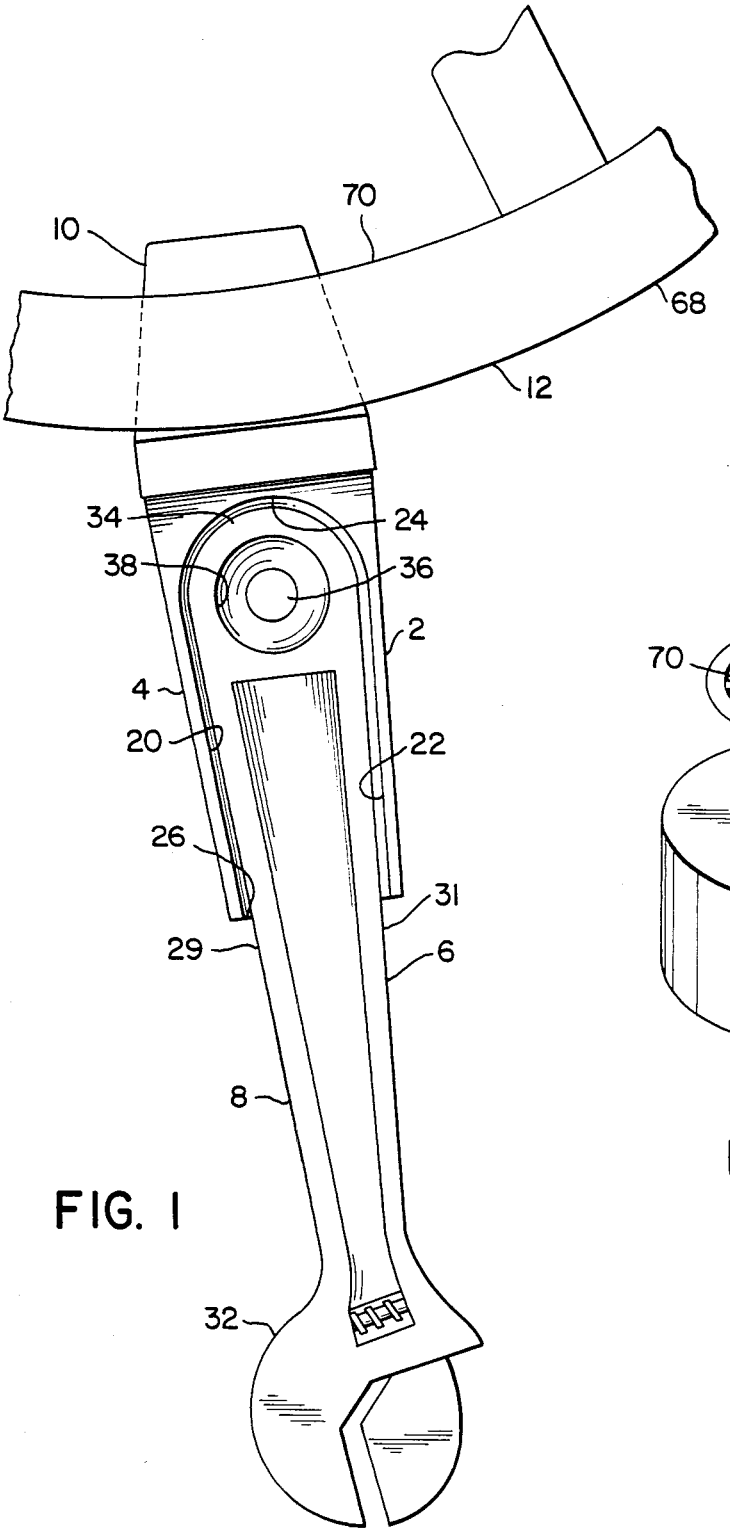
FIG. 1 is a plan view of a valve wrench on the wheel of a hand wheel valve operator, a fragment of which is shown, and showing an adjustable wrench seated in the coupling recess of the valve wrench for connecting thereto to provide leverage.
Figure 7:
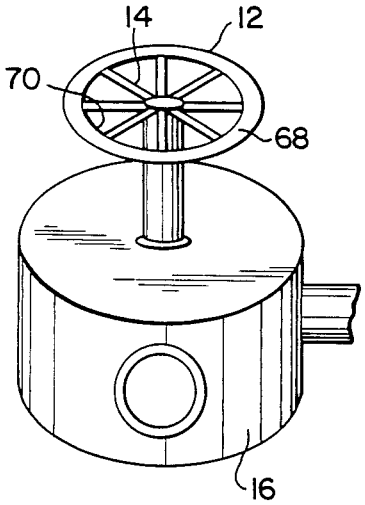
FIG. 7 is a perspective view of a valve and hand wheel valve operator of the type for which the valve wrench in accordance with this invention is useable.
Figure 2:
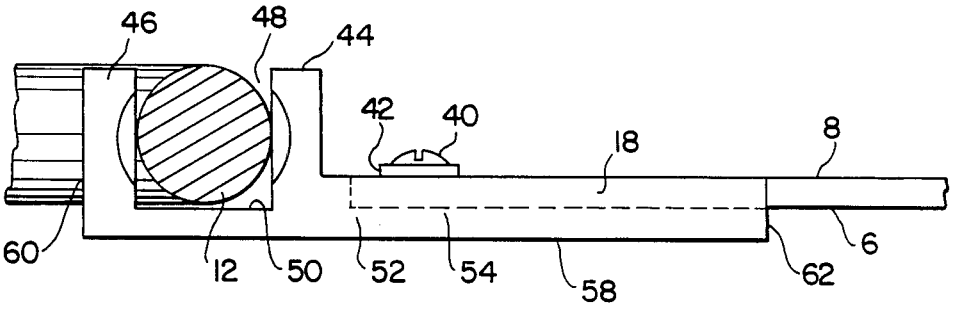
FIG. 2 is a side elevation view of the valve wrench shown in FIG. 1 with the connecting screw and washer in place to hold the adjustable wrench seated in the coupling recess, a fragment of the handle of the adjustable wrench being shown.
Figure 3:
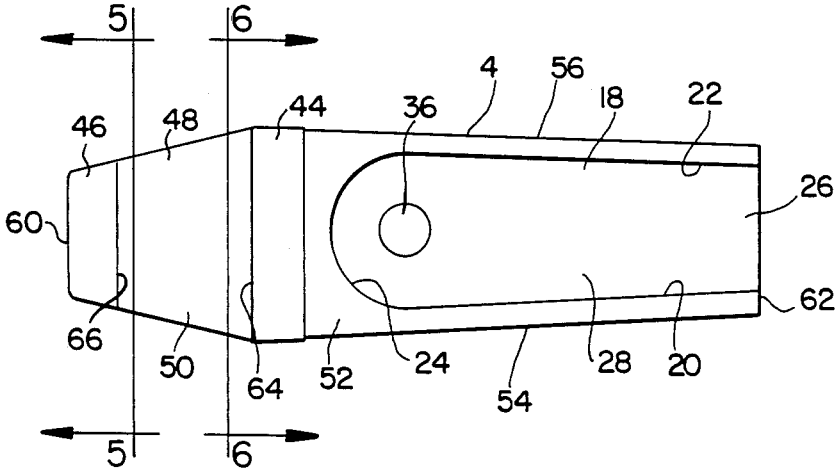
FIG. 3 is a plan view of the valve wrench in accordance with this invention shown with the adjustable wrench removed.
Figure 4:
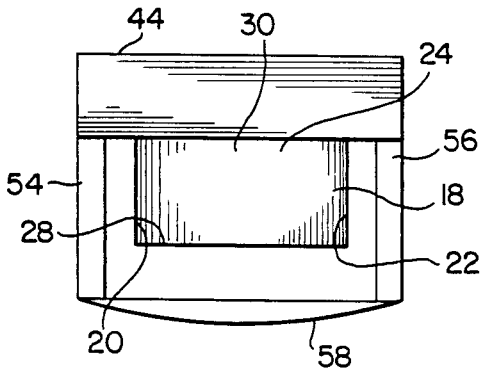
FIG. 4 is an end elevation view of a valve wrench in accordance with this invention having a rounded bottom wall.
Figure 5:
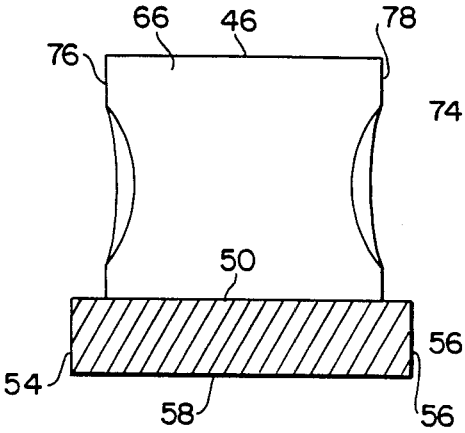
FIG. 5 is a section view taken on line 5—5 of FIG. 3, showing the relatively narrower slot facing surface of the outer jaw member and the beveled side edges thereof.
Figure 6:
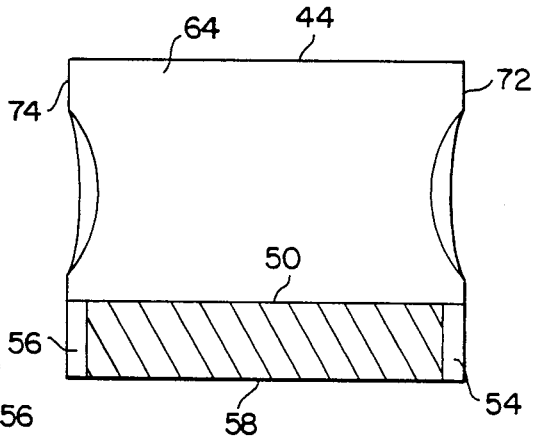
FIG. 6 is a section view taken on line 6—6 of FIG. 3, showing the relatively wider slot facing surface of the inner jaw member and the beveled side edges thereof.
Figure 8:
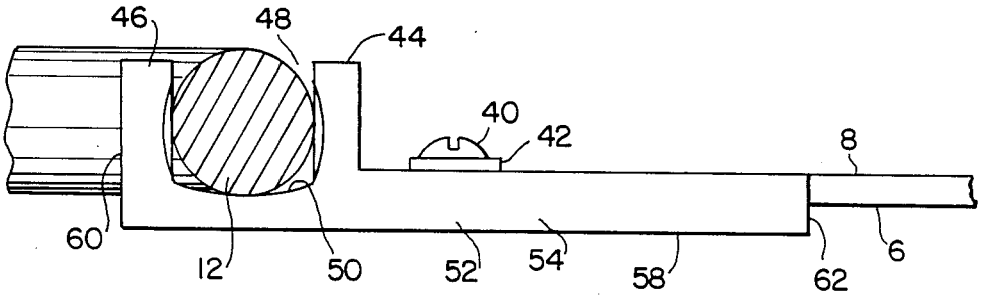
FIG. 8 is a side elevation view similar to FIG. 2 but showing a receiving slot between the jaw members having a rounded bottom wall.

A valve wrench 2 in accordance with the present invention includes an elongated coupling section 4 for coupling to an elongated member such as the handle 6 of an adjustable wrench 8 to provide leverage, and a gripping section 10 to grip a portion of the wheel or ring 12 of a hand wheel valve operator 14 for opening and closing of a valve 16.

The coupling section 4 includes a recess 18 to receive an elongated member for leverage such as the handle 6 of adjustable wrench 8, the recess 18 being bounded by a first side wall 20, an opposite second side wall 22, an outer end wall 24, an open end inner wall 26, a bottom recess wall 28 and an open top wall 30.

The side walls 20 and 22 which bound the recess 18 are spaced apart and directionally oriented to correspond to the elongated member which is to provide the leverage, such as the handle 6 of an adjustable wrench 8. For use therewith, the side walls 20 and 22 are each straight and they diverge slightly in the direction from open inner end wall 26 to outer end wall 24 to correspond with the slightly diverging side edges 29 and 31 of the adjustable wrench handle 6 in the direction from its working end 32 toward its outer handle end 34. The outer end wall 24 of the valve wrench recess 18 is curved to correspond with the curve of the outer handle end 34 of the adjustable wrench 8.

The bottom recess wall 28 of the recess 18 includes an internally threaded aperture 36 spaced apart inwardly from the outer end wall 24 a distance needed to center it in registration with the aperture 38 through the handle 6 of the adjustable wrench 8 at its outer handle end 34. A threaded bolt or screw 40 having a washer 42 thereon is received through aperture 38 of the adjustable wrench 8 and threadedly received in the internally threaded aperture 36 for tightening to clamp the handle 6 of the adjustable wrench 8 to the coupling section 4 of the valve wrench 2.

The width across the open inner end wall 26 of the valve wrench recess 18 is smaller than the cross-section of the portions of the adjustable wrench handle 6 received in and seated in the recess 18 rearwardly of the inner end wall 26. The valve wrench 2 cannot therefore be moved axially outwardly from the adjustable wrench 8 when its handle end 34 is seated in place in the recess 18 of the valve wrench 2.

The gripping section 10 of the valve wrench 2 comprises an integrally formed extension of the coupling section 4, having a pair of jaw members 44 and 46 spaced apart to define a valve wheel receiving slot 48 therebetween. Jaw member 44 is adjacent to and outwardly from the outer end wall 24 of the valve wrench recess 18, and extends in a direction normal to the longitudinal axis of the elongated valve wrench recess 18. Jaw member 46 is spaced apart outwardly from jaw member 44 and extends parallel thereto. A bottom slot wall 50 of slot 48 extends between the jaw members 44 and 46. The entire coupling section 4 and gripping section 10 of the valve wrench 2 are integrally joined in the valve body 52 bounded by the valve body outer side walls 54 and 56, valve body bottom wall 58, valve body outer end wall 60 and valve body inner end 62.

The valve body outer side walls 54 and 56 diverge outwardly slightly in the direction from valve body inner end 62 toward their juncture with the inner jaw member 44, at which point they begin to converge inwardly in the direction toward the outer jaw member 46 and the valve body outer end wall 60.

Inner jaw member 44 is wider than outer jaw member 46. The slot facing surface 64 of inner jaw member 44 which faces slot 48 is greater in dimension in the direction from valve body outer side wall 54 to valve body outer side wall 56, than is the slot facing surface 66 of outer jaw member 46. Both slot facing surfaces 64 and 66 are straight, flat planar surfaces which extend opposite from each other in substantially parallel spaced apart planes.

The circular wheel or ring 12 of the hand wheel valve operator 14 has an outer circumference 68 of greater dimension than its inner circumference 70. The slot facing surface 64 of inner jaw member 44 is made relatively wider than that of slot facing surface 66 of outer jaw member 46 to position the wider slot facing surface 64 against the larger outer circumference 68 of wheel 12 and the narrower slot facing surface 66 against the smaller inner circumference 70 when wheel 12 is received in slot 48 of the valve wrench 2.

When the inwardly facing surfaces of a pair of jaw members are straight and a circular object is to be received between them, the jaw members can be closer together for a better fit the shorter the dimension of the jaw member bordering the inner and smaller circumference. The jaw member bordering the outer and larger circumference can be wider and have a longer surface bordering the outer and larger circumference of the circular object to bear against a wider portion of the circular object when applying force to rotate such circular object on its axis, to thereby diffuse the forces for absorption over a greater cross-sectional area of the circular object. The tendency of the jaw members to pivot or rock relative to an arcuate object received between them when rotational leverage is applied outwardly from the outer circumference, is to pivot or rock in a radius determined by the width of the jaw member bearing against the inner circumference. If both jaw members are of equal width, the edges of the jaw member bearing against the larger outer circumference would begin to bite into and damage the outer circumference of such arcuate object when pivoted or rocked about such arcuate object on a radius determined by the jaw member bearing against the inner circumference. By enlarging the width of the jaw member bearing against the outer circumference, only the flat planar surface of the jaw member comes into contact with the outer circumference of the circular object, thereby preventing the biting into and damage of the outer circumference of the circular object that would occur if such jaw member was not as wide, if it was for example the same width as the jaw member bearing against the inner circumference.

The upwardly extending side edges 72 and 74 of slot facing surface 64 are accordingly spaced farther apart than the upwardly extending side edges 76 and 78 of slot facing surface 66.

To further minimize biting into and damage of the inner as well as the outer circumferences of an arcuate object received in the slot 48 between jaw members 44 and 46, the side edges 72, 74, 76 and 78 may be slightly beveled or chamfered to present a rounded rather than sharp cutting edge to portions of the outer and inner circumferences 68 and 70 of the wheel or ring 12.

The configuration and dimension of the recess 18 is particularly adapted to receive the end portion of the handle 6 of the adjustable wrench 8 as shown in the drawing. The side walls 20 and 22 of the recess 18 extend far enough along the corresponding side edges 29 and 31 of the adjustable wrench 8 from its outer handle end 34 to provide strong lateral support when the wrench 8 coupled to the valve wrench 2 is moved laterally to begin to rotate the hand wheel valve operator. Such length of side walls 20 and 22 which border the recess 18 also gives the valve wrench 2 substantially equal weight distribution on each opposite side longitudinally of the internally threaded aperture 36 through the bottom recess wall 28. The valve wrench 2 can therefore be more easily connected to the adjustable wrench 8 by holding the valve wrench 2 above the adjustable wrench 8 with its recess 18 facing downward and centered to receive the corresponding end portion of the handle 6 of the adjustable wrench 8 and the aperture 36 of the valve wrench 2 in registration with the corresponding aperture 38 of the adjustable wrench 8. The substantially equal weight distribution of valve wrench 2 on each opposite side longitudinally of it aperture 36 enables the valve wrench 2 to lay flat and in place on the adjustable wrench 8 when received in the recess 18 from below with both wrenches 2 and 8 held substantially in a horizontal position. This enables a workman to insert the bolt or screw 40 through the adjustable wrench aperture 38 from below to thread it into the internally threaded aperture 36 of the valve wrench 2 while holding the adjustable wrench 8 with one hand and the bolt or screw 40 with his other hand. The valve wrench 2 will not rock out of position when placed on the handle of the adjustable wrench 8 in this manner. The substantially equal weight distribution of the valve wrench 2 on each longitudinal side of the connecting point to the adjustable wrench 8 also tends to keep the handle of the adjustable wrench 8 seated in the recess 18 of the valve wrench 2 when held the opposite way with the recess 18 facing upward, even if the connecting bolt or screw 40 becomes loosened.

The valve body bottom wall 58 may have an arcuate cross-sectional surface configuration. The bottom slot wall 50 may have an arcuate configuration extending laterally to correspond with the arcuate configuration of the wheel or ring 12 when received in the slot 48 between jaw members 44 and 46.

The entire valve wrench 2 including said elongated coupling section 4 and said gripping section 10 and their structural parts are all integrally formed as a single unitary piece, except for the bolt or screw 40 which couples the valve wrench 2 to the adjustable wrench 8.

This invention is particularly useful to workmen in plants and elsewhere who typically carry an adjustable wrench with them as part of their regular working equipment. To open valves, they only need the relatively small connecting valve wrench in accordance with this invention as an additional item to carry. The close fitting recess having both an open top wall and an open end wall make seating of the handle end of the adjustable wrench therein easy and quick. Only a single bolt or screw is needed to securely clamp the valve wrench to the handle of the elongated adjustable for leverage.

After using the wrench to open a valve, it can just as easily and quickly be removed from the adjustable wrench by simply unscrewing the single connecting bolt and lifting from the recess through its open top wall. A connecting recess having an open top wall and an open end wall can easily be kept free of dirt, rust, moisture and other materials which tend to accumulate in connecting recesses having completely surrounding peripheral walls.

We claim:

1. A valve wrench for use with a valve operator to open and close a valve, such valve operator having an arcuate gripping means member, said valve wrench comprising coupling means to couple said valve wrench to an elongated member for leverage, jaw means to receive said arcuate gripping member of said valve operator, said jaw means including protective means to protect against damage to said arcuate gripping member of said valve operator, wherein said jaw means includes a first jaw member, a second jaw member spaced apart from said first jaw member defining a receiving slot therebetween to receive said arcuate gripping member of said valve operator, said protective means of said jaw means including a first surface on said first jaw member facing said receiving slot having a relatively short lateral dimension extending in the direction of rotation of said arcuate gripping member of said valve operator as it is moved to open and close said valve, and a second surface on said second jaw member facing said lateral slot having a relatively longer lateral dimension than that of said first surface of said first jaw member extending in the direction of rotation of said arcuate gripping member of said valve operator as it is moved to open and close said valve.

2. A valve wrench as set forth in claim 1, wherein said first surface on said first jaw member and said second surface on said second jaw member are substantially flat, straight and planar throughout, and lie respectively in spaced apart substantially parallel planes.

3. A valve wrench as set forth in claim 1, wherein said receiving slot between said first jaw member and said second jaw member includes a bottom slot wall, said bottom slot wall having an arcuate configuration corresponding to the arcuate configuration of said arcuate gripping member of said valve operator when received in said receiving slot.

4. A valve wrench comprising an integrally formed unitary tool extending longitudinally from a first end to a second end, a receiving recess to receive an elongated member for leverage, said recess extending from an intermediate portion of said valve wrench and terminating at said first end in an open end wall, said valve wrench including a first jaw member at said second end thereof, a second jaw member spaced apart from said first jaw member in the direction toward said first end of said unitary tool to define a receiving slot between said first and second jaw members to receive a portion of a valve operator therein, said unitary tool having first and second spaced apart side walls extending from said first end thereof to said second end thereof, said first jaw member having a first planar surface facing said receiving slot extending laterally in the direction from said first side wall across to said second side wall for a relatively short distance, said second jaw member having a second planar surface facing said receiving slot extending laterally in the direction from said first side wall across to said second side wall for a relatively greater distance than said first planar surface of said first jaw member, the lateral dimension of said second planar surface being greater than the lateral dimension of said first planar surface, the centers of said first and second surfaces being substantially in axial alignment.

5. A valve wrench as set forth in claim 4, wherein said first jaw member includes a first pair of spaced apart side edges, said second jaw member includes a second pair of spaced apart side edges, said side edges of said first and second pair being beveled to provide rounded contact surfaces when they are brought into contact with said portion of said valve operator received between said jaw members as said valve wrench is moved to in turn move said valve operator.

6. A valve wrench as set forth in claim 4, wherein said unitary tool includes a bottom wall extending from said first end to said second end, an aperture in said unitary tool opening on one side to said bottom wall and on its opposite side to said receiving recess, to receive a securing member therethrough to secure said elongated member to said unitary tool when received in said recess.

7. A valve wrench as set forth in claim 6, wherein said receiving recess includes a pair of side walls which extend from said intermediate portion of said valve wrench to said open end wall at said first end thereof, said side walls diverging as they extend from said open end wall toward said intermediate portion of said valve wrench, a closed end wall of said recess extending between said side walls at said intermediate portion of said valve wrench, said open end wall having a smaller lateral dimension between said side walls than the lateral dimension of said closed end wall between said side walls.

8. A valve wrench as set forth in claim 7, including said elongated member to be coupled to said valve wrench for leverage, said elongated member comprising an adjustable wrench having an elongated handle, said elongated handle having an outer end wall corresponding in configuration and dimension to that of said closed end wall of said receiving recess of said valve wrench, a pair of said walls of said elongated handle of said adjustable wrench extending from said outer end wall thereof and converging as they extend toward the opposite end of said adjustable wrench to a degree corresponding to the degree said pair of side walls of said receiving recess diverge as they extend toward said closed end wall of said recess, said elongated handle of said adjustable wrench being receivable in said receiving recess of said valve wrench from its outer end wall seated adjacent said closed end wall of said receiving recess to the point on said handle which is adjacent said open end wall of said recess, said valve wrench being held against longitudinal movement in one direction relative to said adjustable wrench by said closed end wall of said recess and against longitudinal movement in the opposite direction relative to said adjustable wrench by said smaller lateral dimension of said open end end wall of said recess than the portion of the handle of said adjustable wrench which is received in said receiving recess.

9. A valve wrench as set forth in claim 8, wherein said aperture opening to said bottom wall on one side and to said receiving recess on its other side includes an internally threaded passageway, said handle of said adjustable wrench includes an aperture which is in registration with said aperture of said valve wrench opening to said receiving recess, and a screw having a threaded shank receivable through said aperture in said handle of said adjustable wrench for threaded engagement with said internally threaded passageway of said valve wrench aperture to secure said valve wrench to said handle of said adjustable wrench.

10. A valve wrench as set forth in claim 4, wherein said integrally formed unitary tool includes a pair of side walls extending from said open end wall at said first end toward said second jaw member spaced apart inwardly of said second end thereof and diverging as they extend toward said second jaw member, said pair of side walls then converging as they extend past said second jaw member to terminate at said second end adjacent said first jaw member, said unitary tool including a bottom wall extending longitudinally from said first end to said second end thereof.

11. A valve wrench as set forth in claim 10, wherein said bottom wall of said unitary tool is planar throughout.

* * * * *